US011484072B1

(12) United States Patent
Kim

(10) Patent No.: US 11,484,072 B1
(45) Date of Patent: Nov. 1, 2022

(54) NECK WARMER WITH ADJUSTABLE FUNCTION

(71) Applicant: Bongsoo Kim, Daegu Metropolitan (KR)

(72) Inventor: Bongsoo Kim, Daegu Metropolitan (KR)

( * ) Notice: Subject to any disclaimer, the term of this patent is extended or adjusted under 35 U.S.C. 154(b) by 0 days.

(21) Appl. No.: 17/732,217

(22) Filed: Apr. 28, 2022

(51) Int. Cl.
*A41D 13/11* (2006.01)
*A41D 23/00* (2006.01)
*A41D 15/04* (2006.01)

(52) U.S. Cl.
CPC ..... *A41D 15/04* (2013.01); *A41D 13/11* (2013.01); *A41D 23/00* (2013.01); *A41D 2400/10* (2013.01)

(58) Field of Classification Search
CPC .... A41D 13/11; A41D 13/1107; A42B 1/006; A42B 1/046; D04B 1/24
See application file for complete search history.

(56) References Cited

U.S. PATENT DOCUMENTS

2007/0051370 A1* 3/2007 Baker ..... A41D 13/11 128/206.19
2009/0307823 A1* 12/2009 Matsushita ..... A41D 1/04 2/116
2019/0208845 A1* 7/2019 Gellis ..... D04B 1/102
2021/0145094 A1* 5/2021 Diemer ..... A41D 23/00
2022/0015491 A1* 1/2022 Stevens ..... A41D 13/1192
2022/0039493 A1* 2/2022 Thompson ..... A41D 13/1161

* cited by examiner

*Primary Examiner* — Katherine M Moran
(74) *Attorney, Agent, or Firm* — Georgi Korobanov

(57) ABSTRACT

A neck warmer with adjustable function comprises a warmer body with first opening and second opening; and a first ear accommodating hole and a second ear accommodating hole, which can be hung on the ear so that the warmer body adopts single-layer waring form, or fold the warmer body in half, hang the first and second ear accommodating holes on the ears, so that the warmer body adopts a double-layer wearing form. The warmer body is made of seamless and comfortable high-stretch fabric. A certain number of ear accommodating holes are formed on both sides and middle of the warmer body. In order to cope with the external environment including air temperature and severe haze weather, the warmer body adopts a design structure that can be worn in a single layer or folded in half to form a double-layer structure, so as to achieve the purpose of multi-layer protection.

6 Claims, 3 Drawing Sheets

NECK WARMER WITH ADJUSTABLE FUNCTION

CROSS-REFERENCE TO RELATED APPLICATIONS

This application claims the benefit and priority of Korean patent application No. 1020210138158, filed on Oct. 18, 2021, disclosure of which is hereby incorporated by reference in its entirety.

TECHNICAL FIELD

The present invention relates to the field of neck warmers, in particular to a neck warmer with adjustable function.

BACKGROUND

In recent years, people who are keen on outdoor sports and leisure activities have continued to grow, and for this reason, there are also many buff products on the market for protecting the neck and face during outdoor activities. The buff is also called a scarf or earmuff, and has an open cylindrical structure at both ends. Since this buff uses a cylindrical cloth covering the neck or face, it is easier to wear than a general scarf or muffler, and since it is worn close to the face or neck, the convenience of activity is guaranteed. Especially in winter when the temperature is low and after sunset, it has a strong practical effect when riding or skiing at night. However, with the vigorous physical movement of the wearer, the product also has the disadvantage of being easily removed from the original fixed position of wearing.

In the previously published Korean Patent 10-1954022, whose application date is Jun. 21, 2018, publication date: May 22, 2019, publication number: KR101954022B1, a buff product is disclosed, which comprises a cylindrical structure. This cylindrical structure comprises: a neck covering part, which can cover the face from the eyes to the neck part after wearing; a sealing covering part, which is located on the front of the neck covering part, forms a certain isolation space between the nose and the mouth of the user and covers the nose and mouth in the face when wearing; a fitting ring formed in the upper edge portion of the neck covering portion for applying external pressure along the level of the face to make the upper end portion of the neck covering part fit completely with the face portion; a filter ring assembly, located inside the sealing covering part, to filter air through the nose and mouth; and face fitting part, located in the neck covering part, has one end connected to the sealing covering part, and exerts an external pressing force along the curved structure of the face through its own elasticity, so that the sealing covering part and the neck covering part are closely fitted along the curve structure of the face.

SUMMARY OF THE APPLICATION

To sum up, the prior art does not adopt the technology of isolating smog and preventing the product from falling off the bottom of the chin during activity, and solves the problem that it does not have the function of isolating the external harmful environment including haze.

The technical solution of the present invention is: a neck warmer with adjustable function, comprising a warmer body, which is configured to be formed with a first opening and a second opening forming a through structure along the up-down direction; wherein a first ear accommodating hole and a second ear accommodating hole which can be hung on the ears are respectively formed at the ends on both sides of the first opening and the second opening in the warmer body, the first ear accommodating hole can be hung on the ear so that the warmer body has a single-layer wearing form, or the warmer body can be folded in half, and the first ear accommodating hole and the second ear accommodating hole are hung on the ears, so that the warmer body has a double-layer wearing form.

Further, the warmer body is configured to be made of a seamless and comfortable high-stretch fabric.

Further, a third ear accommodating hole and a fourth ear accommodating hole spaced apart from each other are respectively formed in the middle part of the warmer body, and the warmer body is folded in half, so that the third ear accommodating hole and the fourth ear accommodating hole are overlapped and hung on the ears, so that the neck cover body is in a double-layer wearing form.

Further, the warmer body comprises: a warmer fabric part with a cylindrical structure, a first edge elastic band and a second edge elastic band, which are arranged at the end on both sides of the warmer fabric part and have stronger elastic elasticity than the warmer fabric part; a central elastic band which has stronger elastic elasticity in the middle part of the warmer fabric part than the warmer fabric part.

Further, a first ventilation fabric part and a second ventilation fabric part are respectively formed between the central elastic band, the first edge elastic band and the second edge elastic band, the first ventilation fabric part and the second ventilation fabric part have a lower density than the warmer fabric part, and are just at the positions corresponding to the respiratory organs of a wearer.

Further, the first ventilation fabric part and the second ventilation fabric part are configured to have different fabric densities, and in the case of different external environmental conditions such as temperature and haze concentration, one of the first ventilation fabric part and the second ventilation fabric part can be selected to wear, or the first ventilation fabric part and the second ventilation fabric part can be overlapped in order to obtain a double-layer structure.

Further, the warmer body is folded in half to form a bag-like structure between the first ventilation fabric part and the second ventilation fabric part, and KF filter paper is inserted inside the bag-like structure.

Compared with the prior art, the present invention has the following beneficial effects: The warmer body is made of seamless and comfortable high-stretch fabric. A certain number of ear accommodating holes are formed on both sides and middle of the warmer body. In order to cope with the external environment including air temperature and severe haze weather, the warmer body adopts a design structure that can be worn in a single layer or folded in half to form a double-layer structure, so as to achieve the purpose of multi-layer protection.

Figure 1:
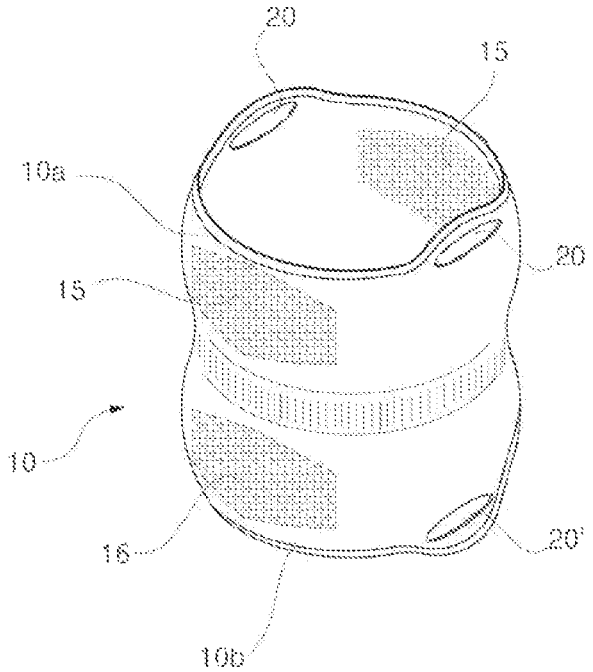
FIG. 1 is an overall structural diagram of a neck warmer with adjustable function according to an embodiment of the present invention.

The realization, functional characteristics and advantages of the objects of the present invention will be further described with reference to the accompanying drawings in conjunction with the embodiments.

DETAILED DESCRIPTION

The technical solutions in the embodiments of the present application will be clearly and completely described below with reference to the drawings in the embodiments of the present application. Obviously, the described embodiments are only a part of the embodiments of the present application, rather than all the embodiments. Based on the embodiments in the present application, all other embodiments obtained by those of ordinary skill in the art without creative efforts shall fall within the protection scope of the present application.

It should be noted that all directional indications (such as up, down, left, right, front, back, etc.) in the embodiments of the present invention are only used to explain the relationship between various components under a certain posture (as shown in the accompanying drawings). The relative positional relationship, the movement situation, etc., if the specific posture changes, the directional indication also changes accordingly.

In addition, descriptions involving "first", "second", etc. in the invention are only for descriptive purposes, and should not be construed as indicating or implying their relative importance or implicitly indicating the number of indicated technical features. Thus, a feature delimited with "first", "second" may expressly or implicitly include at least one of that features. In addition, the technical solutions between the various embodiments can be combined with each other, but must be based on the realization by those of ordinary skill in the art. When the combination of technical solutions is contradictory or cannot be realized, it should be considered that the combination of such technical solutions does not exist and is not within the scope of protection required by the present invention.

The neck warmer with adjustable function according to the present application comprises a warmer body 10, a first ear accommodating hole 20 and a second accommodating hole 20'. The warmer body 10 is configured to be made of a seamless and comfortable high-stretch fabric and configured to be formed with a first opening 10*a* and a second opening 10*b* forming a through structure along the up-down direction. The warmer body 10 is turned over on the wearer's head through the first opening 10*a* and the second opening 10*b*. A first ear accommodating hole 20 and a second ear accommodating hole 20' which can be hung on the ears are respectively formed at the ends on both sides of the first opening 10*a* and the second opening 10*b* in the warmer body 10. In this case, the warmer body 10 will wrap the wearer's face including the nose and mouth, and play the functions of heat preservation, shading and mask. The first ear accommodating hole 20 and the second ear accommodating hole 20' are formed with split lines in designated positions in the warmer body 10 adopting the cylindrical knitted structure.

In this case, a pair of first ear accommodating holes 20 are formed on the side of the first opening 10*a* in the warmer body 10, and a pair of second ear accommodating holes 20' are formed on the side of the second opening 10*b*.

To this end, either side of the first opening 10*a* and the second opening 10*b* in the warmer body 10 can be selected to be worn downward, and the warmer body 10 can be used in two directions at the same time.

Figure 2:
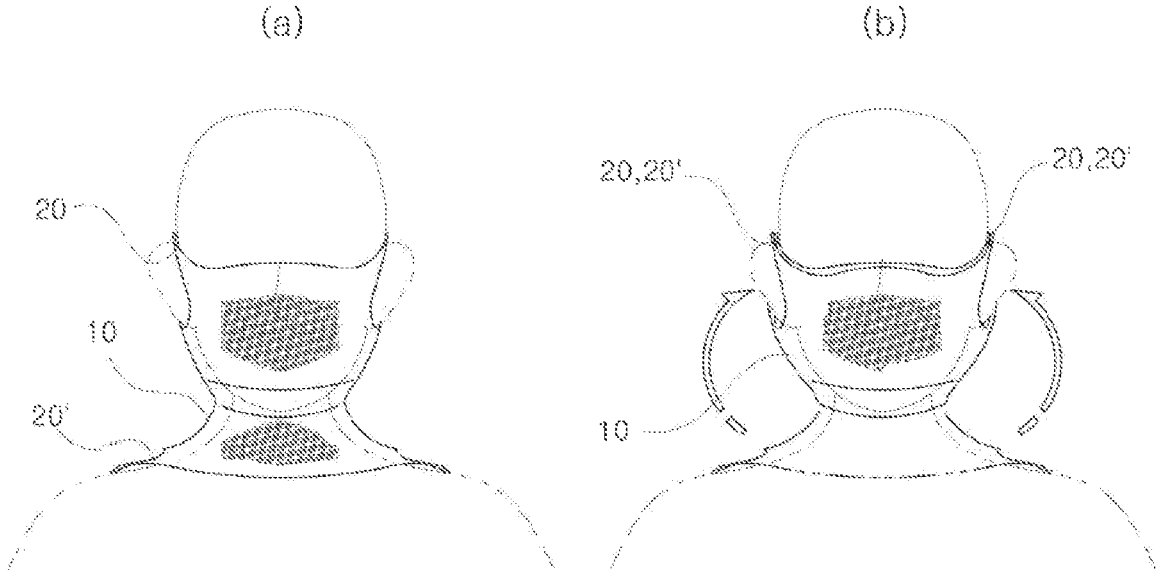
FIG. 2 is a structural diagram of a neck warmer with adjustable function in a wearing state according to an embodiment of the present invention.
Figure 3:
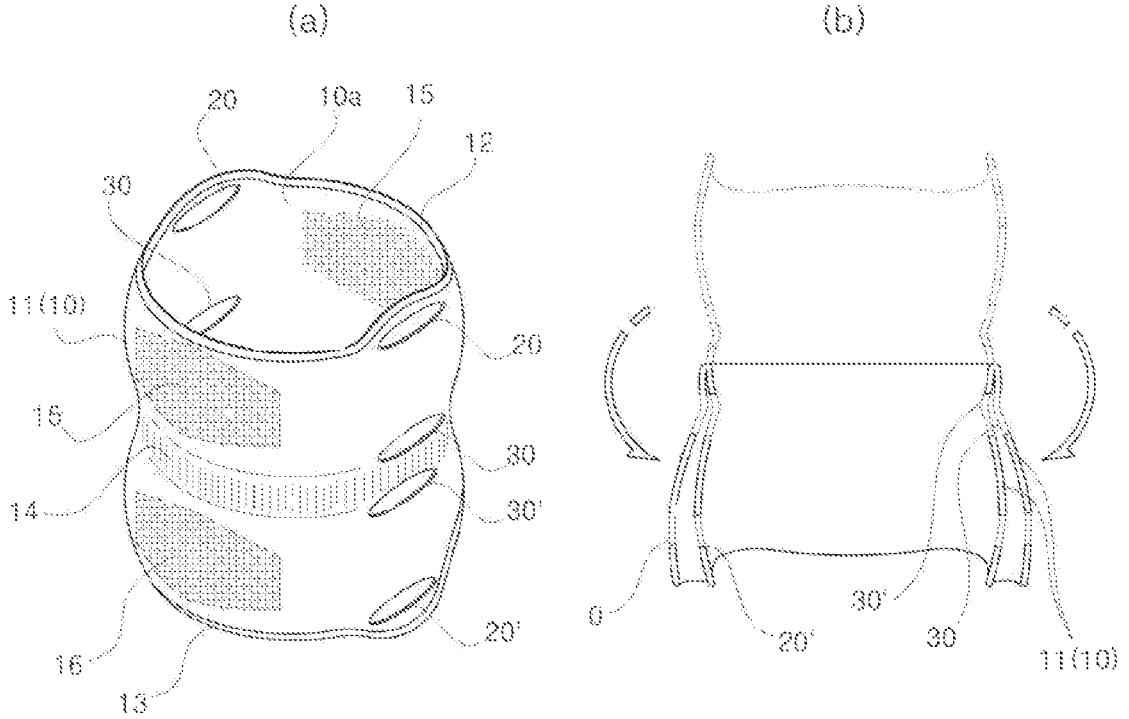
FIG. 3 is a structural diagram showing the third and fourth ear accommodating holes of a neck warmer with adjustable function according to an embodiment of the present invention.

The wearing form of the warmer body 10 can be changed through the first ear accommodating hole 20 and the second ear accommodating hole 20'. As shown in FIG. 2 , when the first ear accommodating hole 20 is hung on the ear, the warmer body 10 will be worn with a single-layer structure. As shown in FIG. 3, when the warmer body 10 is folded in half, and the first ear accommodating hole 20 and the second ear receiving hole 20' are all hung on the ears, the warmer body 10 is in a double-folded wearing state.

When the warmer body 10 is in a double-folded wearing state, the thermal insulation and filtering performance will be improved. Therefore, when engaging in outdoor sports, the wearing mode of the warmer body 10 with a single-layer or double-layer structure can be freely selected according to the external temperature and body temperature.

Specifically, the warmer body 10 in the neck warmer with adjustable function is made of a high-stretch fabric that is seamless and comfortable to wear. A certain number of ear accommodating holes are formed on both sides and the middle of the warmer body. It also has a design structure that can be worn in a single layer or half-folded in a double-layer structure in order to cope with the external environment including severe haze weather. In this case, the warmer body 10 is made of seamless, high-stretch fabric, and is made by a circular loom.

Figure 4:
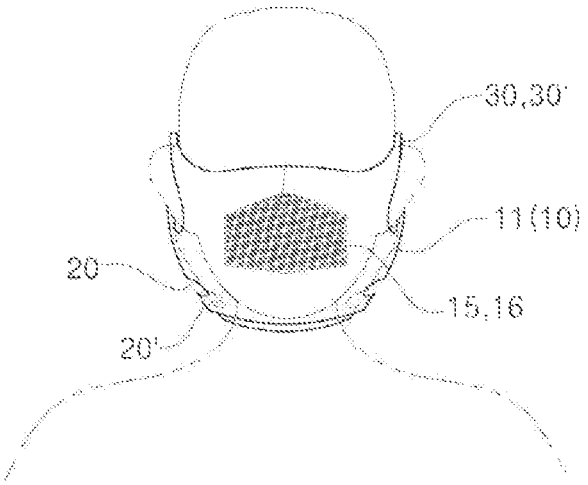
FIG. 4 is a structural diagram of a neck warmer with an adjustable function in FIG. 3 in a wearing state.

In FIG. 3, the third ear accommodating holes 30 and the fourth ear accommodating holes 30', which are located in the middle part of the warmer body 10, are arranged at a specified interval, each of which is a pair. Here, the warmer body 10 is folded in half, as shown in FIG. 4, the third ear accommodating hole 30 and the fourth ear receiving hole 30' are overlapped and hung on the ears, and the warmer body 10 is in a double-folded wearing state.

More specifically, the warmer body 10 comprises: a warmer fabric part 11 with a cylindrical structure, a first edge elastic band 12 and a second edge elastic band 13, which are arranged at the end on both sides of the warmer fabric part 11 and have stronger elastic elasticity than the warmer fabric part 11; a central elastic band 14 which has stronger elastic elasticity in the middle part of the warmer fabric part 11 than the warmer fabric part 11. The first edge elastic band 12 and the second edge elastic band 13 are thicker than the warmer fabric part 11, and thus can provide a soft and comfortable wearing feeling when the first ear accommodating hole 20 and the second ear accommodating hole 20' are hung on the ears. In particular, through the relatively strong elastic elasticity of the first edge elastic band 12 and the second edge elastic band 13, the first opening 10*a* and the second opening 10*b* in the warmer body 10 can be closely fitted with the human body to improve wearing comfort.

Specifically, a first ventilation fabric part 15 and a second ventilation fabric part 16 are respectively formed between the central elastic band 14, the first edge elastic band 12 and the second edge elastic band 13, the first ventilation fabric part 15 and the second ventilation fabric part 16 have a lower density than the warmer fabric part 11, and are just at the positions corresponding to the respiratory organs of a wearer. Therefore, the first ventilation fabric part 15 and the second ventilation fabric part 16 are located at positions corresponding to the wearer's respiratory organs. During field sports, it can provide smooth air circulation conditions according to the inspiratory and expiratory function of the human body, which is conducive to stabilizing the breathing rhythm.

More specifically, KF filter paper is installed on either side of the first ventilation fabric part 15 and the second ventilation fabric part 16. KF filter paper is not installed in ordinary daily life scenes and is only used as an ordinary ventilation fabric part. When it is necessary to communicate face-to-face with others, the first ventilation fabric part 15 and the second ventilation fabric part 16 can be overlapped by folding the warmer body 10, and KF filter paper can be installed at the same time to achieve the effect of isolating external viruses and protecting respiratory organs.

Meanwhile, the first ventilation fabric part 15 and the second ventilation fabric part 16 are composed of fabrics with different densities.

In the case of different external environmental conditions such as air temperature, haze concentration, etc., one of the first ventilation fabric part 15 and the second ventilation fabric part 16 can be arbitrarily selected to be worn. The first ventilation fabric part 15 and the second ventilation fabric part 16 can also be overlapped and used in a double-layer structure, which can provide 3 levels of filtering function and warmth retention.

Figure 5:
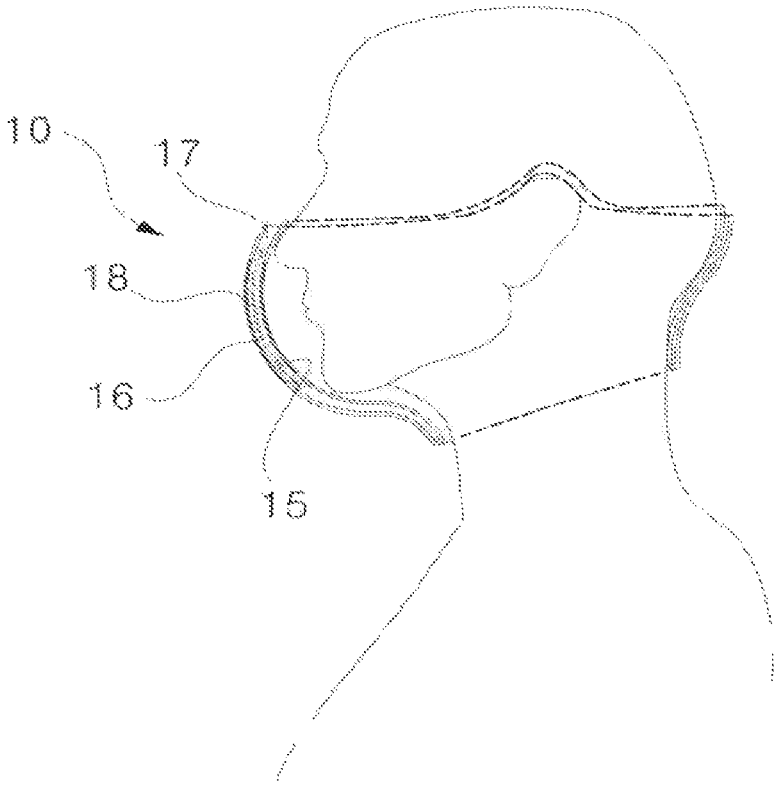
FIG. 5 is a structural diagram of a KF filter paper installed in a bag-like structure of the neck warmer with an adjustable function according to an embodiment of the present invention.

In FIG. 5, after the warmer body 10 is folded in half, the first ventilation fabric part 15 and the second ventilation fabric part 16 overlap each other, and a bag-like structure 17 is formed therebetween.

KF filter paper is inserted into the bag-like structure 17, which can function as a KF mask. At the same time, the KF filter paper can be replaced, and the new KF filter paper 18 can be replaced at any time according to the degree of pollution of the filter paper in outdoor activities. The warmer body 10 can be used repeatedly after cleaning.

The above descriptions are only preferred embodiments of the present invention, and are not intended to limit the patent scope of the present invention. Under the inventive concept of the present invention, any equivalent structural transformations made by using the contents of the description and drawings of the present invention, or directly/indirectly applied in other related technical fields are included in the scope of patent protection of the present invention.

What is claimed is:

1. A neck warmer with adjustable function, comprising a warmer body (10), having a first opening (10*a*) and a second opening (10*b*) forming a through structure along the up-down direction; wherein a first ear accommodating hole (20) and a second ear accommodating hole (20') which can be hung on the ears are respectively formed at the ends on both sides of the first opening (10*a*) and the second opening (10*b*) in the warmer body (10), the first ear accommodating hole (20) can be hung on the ear so that the warmer body (10) has a single-layer wearing form, or the warmer body (10) can be folded in half, and the first ear accommodating hole (20) and the second ear accommodating hole (20') are configured to be hung on a wearer's ear, such that the warmer body (10) has a double-layer wearing form, wherein a third ear accommodating hole (30) and a fourth ear accommodating hole (30') spaced apart from each other are respectively formed in a middle part of the warmer body (10), and the warmer body (10) is configured to be folded in half, with the third ear accommodating hole (30) and the fourth ear accommodating hole (30') overlapping each other and hung on the wear's ears, with the warmer body (10) in a double-layer wearing form.

2. The neck warmer with adjustable function according to claim 1, wherein the warmer body (10) is made of a seamless and comfortable stretchable fabric.

3. The neck warmer with adjustable function according to claim 1, wherein the warmer body (10) comprises: a warmer fabric part (11) with a cylindrical structure, a first edge elastic band (12) at an upper end of the warmer body (10) and a second edge elastic band (13) at a lower end of the warmer body (10), and the first edge elastic band (12) and the second edge elastic band (13) are more elastic than the warmer fabric part (11); a central elastic band having (14) stronger elastic elasticity and positioned in a middle part of the warmer fabric part (11) such that the middle part is more elastic than the warmer fabric part (11).

4. The neck warmer with adjustable function according to claim 3, wherein a first ventilation fabric part (15) and a second ventilation fabric part (16) are respectively formed between the central elastic band (14), the first edge elastic band (12) and the second edge elastic band (13), the first ventilation fabric part (15) and the second ventilation fabric part (16) have a lower density than the warmer fabric part (11), and are configured to be positioned at respiratory organs of a wearer.

5. The neck warmer with adjustable function according to claim 4, wherein the first ventilation fabric part (15) and the second ventilation fabric part (16) have different fabric densities, and in the case of different external environmental conditions such as temperature and haze concentration, one of the first ventilation fabric part (15) and the second ventilation fabric part (16) can be selected to wear, or the first ventilation fabric part (15) and the second ventilation fabric part (16) can be overlapped in order to obtain a double-layer structure.

6. The neck warmer with adjustable function according to claim 5, wherein the warmer body (10) is folded in half to form a bag-like structure (17) between the first ventilation fabric part (15) and the second ventilation fabric part (16), and KF filter paper (18) is inserted inside the bag-like structure (17).

* * * * *